US010287727B2

(12) United States Patent
Katsuya

(10) Patent No.: US 10,287,727 B2
(45) Date of Patent: May 14, 2019

(54) HIGHLY WATER REPELLENT CONJUGATE FIBER AND HIGH BULK NONWOVEN FABRIC USING THE SAME

(75) Inventor: Masahito Katsuya, Osaka (JP)

(73) Assignees: ES FiberVisions CO., LTD., Osaka (JP); ES FiberVisions Hong Kong Limited, Kowloon (HK); ES FiberVisions LP, Athens, GA (US); ES FiberVisions ApS, Varde (DK)

( * ) Notice: Subject to any disclaimer, the term of this patent is extended or adjusted under 35 U.S.C. 154(b) by 0 days.

(21) Appl. No.: 13/203,364

(22) PCT Filed: Feb. 26, 2010

(86) PCT No.: PCT/JP2010/053595

§ 371 (c)(1),
(2), (4) Date: Aug. 25, 2011

(87) PCT Pub. No.: WO2010/098504

PCT Pub. Date: Sep. 2, 2010

(65) Prior Publication Data

US 2011/0306260 A1 Dec. 15, 2011

(30) Foreign Application Priority Data

Feb. 27, 2009 (JP) ..... 2009-046123

(51) Int. Cl.

| | |
|---|---|
| ***D06M 13/256*** | (2006.01) |
| ***D01F 8/06*** | (2006.01) |
| ***D01F 8/14*** | (2006.01) |
| ***D04H 1/70*** | (2012.01) |
| ***D06M 13/272*** | (2006.01) |
| ***D06M 15/643*** | (2006.01) |
| ***D06M 15/647*** | (2006.01) |

(52) U.S. Cl.

CPC ..... *D06M 13/256* (2013.01); *D01F 8/06* (2013.01); *D01F 8/14* (2013.01); *D04H 1/70* (2013.01); *D06M 13/272* (2013.01); *D06M 15/643* (2013.01); *D06M 15/647* (2013.01); *D06M 15/6436* (2013.01); *Y10T 428/2933* (2015.01); *Y10T 442/603* (2015.04)

(58) Field of Classification Search

CPC ..... D01F 8/06; D01F 8/14; D01F 8/00–8/18; D04H 1/70; D04H 13/00; D04H 1/42; D06M 13/256; D06M 15/643; D06M 15/6436; D06M 15/647; D06M 13/272; D06M 101/16; D06M 13/402; D06M 101/32; D06M 13/224; D06M 13/02; D06M 101/00; D06M 13/144; D06M 13/244; D06M 101/20; D06M 101/18; D06M 101/30; D06M 13/419; D06M 13/322; D06M 13/248; D06M 15/65; D06M 15/66; D06M 7/00; D06M 2200/00; D06M 2200/40; D06M 14/06; D06M 14/04; D06M 15/227; D06M 15/233; D06M 13/2243; D06M 15/53; D06M 15/576; D06M 15/263; D06M 15/277; D06M 15/657; D02G 3/00; D02G 1/026; A41D 31/00; Y10S 428/913; C09D 127/12; C09D 175/04; C09D 183/06; C08L 75/04; C08L 33/16; C09K 3/18; C08G 18/62; C08G 59/306; C08G 59/30; C08G 59/00; C08G 77/38; C08G 77/14; C08G 77/06; C08G 77/22; C08G 77/16; C08G 77/12; C08G 77/70; C08G 77/80; Y10T 428/2962; Y10T 428/2922; Y10T 428/2913; Y10T 428/2933; D21H 19/32; D21H 21/22

USPC ..... 428/389, 395, 391, 394, 379, 375, 364, 428/447, 452, 451, 413, 373, 378, 903; 442/79, 102, 83, 359, 333, 334, 382, 364; 156/308.8, 296, 305; 524/158, 160, 161, 524/166, 588, 731, 759, 760, 773, 837

See application file for complete search history.

(56) References Cited

U.S. PATENT DOCUMENTS

| | | | | |
|---|---|---|---|---|
| 3,511,699 | A * | 5/1970 | Sterman et al. | 442/81 |
| 3,697,469 | A * | 10/1972 | Ikoma et al. | 524/837 |
| 4,046,930 | A * | 9/1977 | Johnson et al. | 427/387 |

(Continued)

FOREIGN PATENT DOCUMENTS

| | | |
|---|---|---|
| JP | 03-180580 | 8/1991 |
| JP | 04-352878 | 12/1992 |

(Continued)

OTHER PUBLICATIONS

Machine Translation of JP H11-61651A (1999).*

(Continued)

*Primary Examiner* — Scott R. Walshon

(74) *Attorney, Agent, or Firm* — Hamre, Schumann, Mueller & Larson, P.C.

(57) ABSTRACT

A fiber that can exhibit both excellent antistatic properties and high water repellency, and a high bulk nonwoven fabric with a good texture that exhibits high water repellency. More specifically, a highly water repellent fiber that is a conjugate fiber having a plurality of thermoplastic resins as the primary component thereof and having a fiber treatment agent comprising at least Component (A) and Component (B) below deposited thereon at 0.1 to 1.0 wt % in relation to the weight of the fiber, with Component (A) accounting for 75 to 97 wt % and Component (B) accounting for 25 to 3 wt % of the fiber treatment agent: Component (A): polysiloxane Component (B): alkane sulfonate metal salt.

3 Claims, No Drawings

(56) References Cited

U.S. PATENT DOCUMENTS

| | | | | |
|---|---|---|---|---|
| 4,105,567 | A * | 8/1978 | Koerner | C08G 77/18 252/8.84 |
| 4,184,004 | A * | 1/1980 | Pines et al. | 442/102 |
| 4,625,010 | A * | 11/1986 | Huhn et al. | 528/31 |
| 4,666,764 | A * | 5/1987 | Kobayashi et al. | 442/60 |
| 4,938,832 | A | 7/1990 | Schmalz | |
| 5,087,520 | A * | 2/1992 | Suzuki et al. | 428/389 |
| 5,151,321 | A * | 9/1992 | Reeves et al. | 442/79 |
| RE35,621 | E | 10/1997 | Schmalz | |
| 5,750,256 | A * | 5/1998 | Ito et al. | 428/375 |
| 6,905,985 | B1 * | 6/2005 | Schindzielorz et al. | 442/65 |
| 7,291,239 | B2 | 11/2007 | Polanco et al. | |
| 2003/0039834 | A1 * | 2/2003 | Gunn | 428/375 |
| 2003/0118816 | A1 | 6/2003 | Polanco et al. | |
| 2004/0198124 | A1 | 10/2004 | Polanco et al. | |
| 2005/0098256 | A1 | 5/2005 | Polanco et al. | |
| 2007/0088122 | A1 * | 4/2007 | Liles et al. | 524/860 |
| 2007/0117482 | A1 * | 5/2007 | Sharma et al. | 442/59 |
| 2008/0302079 | A1 | 12/2008 | Aratani et al. | |

FOREIGN PATENT DOCUMENTS

| | | |
|---|---|---|
| JP | 05-321156 | 12/1993 |
| JP | 07-166426 | 6/1995 |
| JP | 07166426 A * | 6/1995 |
| JP | 08-507331 | 8/1996 |
| JP | 08-291466 | 11/1996 |
| JP | 10-001875 | 1/1998 |
| JP | 11-061651 | 3/1999 |
| JP | 2908841 | 4/1999 |
| JP | 2002-013070 | 1/2002 |
| JP | 2003-193367 | 7/2003 |
| KR | 2004-0073455 | 8/2004 |

OTHER PUBLICATIONS

Database WPI Week 199137, Thomson Scientific, London, GB; AN 1991-271833 XP002611898.

Database WPI Week 199303, Thomson Scientific, London, GB; AN 1993-024162 XP002611899.

* cited by examiner

HIGHLY WATER REPELLENT CONJUGATE FIBER AND HIGH BULK NONWOVEN FABRIC USING THE SAME

TECHNICAL FIELD

The present invention relates to a highly water repellent conjugate fiber having a plurality of thermoplastic resins as the primary component thereof and having excellent antistatic properties, and to a high bulk nonwoven fabric using the same. More particularly, the present invention relates to a highly water repellent fiber and a high bulk nonwoven fabric using the same that are suitable for a leak proof material or liquid impermeable sheet used in a disposable diaper, sanitary napkin, absorbent pad or the like.

BACKGROUND ART

The use of disposable diapers has become widespread, and recently leak proof materials such as side gathers, waist gathers, etc., have been provided thereto to prevent sideways leakage to the thighs or leakage to the waist and lower back of urine and soft feces. Sanitary napkins that feature side gathers to prevent sideways leakage of the menstrual flow have also appeared on the market. A high level of water repellency is required of these leak proof materials to prevent the permeation of urine and menstrual flow. Because such materials also come into direct contact with the skin, they must feel soft and have excellent texture.

Conventionally, a nonwoven fabric, etc., obtained by a spunbond process using a thermoplastic resin such as a polyolefin polymer has been used for such members, but there is still considerable room for improvement in terms of softness and texture.

Many proposals have been made to satisfy the above requirements, and there have also been many technical improvements. For example, a fiber or filament comprising polyolefin that is first treated with an alkyl phosphate ester and then with a polysiloxane has been proposed in Patent document 1.

Alternatively, a heat-bondable fiber having deposited thereon a fiber treatment agent comprising a silicone-based component and an ethylene oxide-added alkyl amine component has been proposed in Patent document 2.

Even with the above technical improvements, there is still room for modification and greater practicality from the viewpoint of achieving both antistatic properties and a high level of water repellency. For example, if an alkyl phosphate ester is used as an antistatic agent in Patent document 1, the antistatic properties are insufficient in the step of processing the fiber into a nonwoven fabric, and because a calendar roll process is used to obtain the nonwoven fabric, it is very difficult to obtain a nonwoven fabric with high bulk and good texture with that method. On the other hand, with Patent document 2 the ratio of the silicone-based component in the fiber treatment agent is relatively low, and even though the ethylene oxide-added alkyl amine imparts additional water repellency, a sufficiently high level of water repellency is still difficult to obtain. Generally speaking, when the bulk of a nonwoven fabric becomes high, the density of the constituent fibers tends to decrease, and the water repellency of the nonwoven fabric tends to decrease as well. Therefore, it is difficult to obtain a high bulk, highly water repellent nonwoven fabric using fibers whereon a fiber treatment agent with such a composition has been deposited.

[Patent document 1] Japanese Patent No. 2908841

[Patent document 2] Japanese Patent Application Publication No. H5-321156

DISCLOSURE OF THE INVENTION

An object of the present invention is to provide a fiber that can exhibit excellent antistatic properties and high water repellency. A further object of the present invention is to provide a high bulk nonwoven fabric using such a fiber that exhibits a high level of water repellency.

As a result of diligent and insightful investigation to achieve the above objects, the inventors discovered that by depositing a fiber treatment agent comprising polysiloxane, which has a high level of water repellency, and an alkane sulfonate metal salt, which has an extremely superb antistatic effect, onto a conjugate fiber having thermoplastic resins as the primary component thereof, that conjugate fiber will have sufficient antistatic properties in the step of processing it into a nonwoven fabric, and a highly water repellent nonwoven fabric with high bulk and good texture can be obtained from that fiber, thus completing the present invention.

Therefore, the present invention is a conjugate fiber having a plurality of thermoplastic resins as the primary component thereof, and having a fiber treatment agent comprising at least Component (A) and Component (B) below deposited thereon at 0.1 to 1.0 wt % in relation to the weight of the fiber, with Component (A) accounting for 75 to 97 wt % and Component (B) accounting for 25 to 3 wt % of the fiber treatment agent:

Component (A): polysiloxane

Component (B): alkane sulfonate metal salt.

A highly water repellent fiber wherein at least one type of the above thermoplastic resin is selected from polyolefin polymers and polyester resins can be noted as an example of the present invention.

The present invention is also intended for a high bulk nonwoven fabric that is fabricated by a process including a carding step using the above highly water repellent fiber.

A fiber treatment agent is deposited on the conjugate fiber of the present invention. Component (A) polysiloxane, the water repellent component, accounts for 75 to 97 wt %, and Component (B) alkane sulfonate metal salt, the antistatic component, accounts for 25 to 3 wt % of that fiber treatment agent. Because the antistatic effect of the antistatic Component (B) alkane sulfonate metal salt is extremely high, the composition ratio thereof can be kept low in the fiber treatment agent. As a result, the composition ratio of the water repellent component polysiloxane can be raised to 75 to 97 wt %, and a high level of water repellency can be realized thereby. Because the conjugate fiber of the present invention has both a high antistatic effect and a high level of water repellency, no static electricity is produced during the process of fabricating the conjugate fiber into a nonwoven fabric, and this enables stable processing.

In addition, because a plurality of thermoplastic resins forms the primary component of the conjugate fiber of the present invention, it is possible to fabricate a high bulk nonwoven fabric by utilizing the differences in melting points of the component thermoplastic resins to thermally bond the fiber intertwining points with hot air circulation type processing equipment, etc. The present invention enables a high bulk nonwoven fabric to be obtained without the loss of water repellency because the water repellency of the conjugate fiber of the present invention remains sufficiently high even if it becomes bulky and the density of the component fibers becomes low.

MODE FOR CARRYING OUT THE INVENTION

Examples of Component (A) polysiloxane constituting the fiber treatment agent to be deposited on the conjugate fiber of the present invention include polydimethylsiloxane, amino-modified polysiloxane, polypropylene glycol-modified polysiloxane, etc. Polydimethylsiloxane is particularly preferred because of its excellent safety and ability to repel water. A commercially available product can be used for Component (A) polysiloxane, and in the case of polydimethylsiloxane, examples include DOW CORNING TORAY SH 200 C FLUID available from Dow Corning Toray Silicone Co., Ltd., WACKER SILICONE FLUID AK available from Wacker Asahikasei Silicone Co., Ltd., and KF-96 available from Shin-Etsu Chemical Co., Ltd.

When using polydimethylsiloxane as Component (A) constituting the fiber treatment agent, a degree of polymerization of 5 to 200 is preferred, and 10 to 100 is more preferred.

Component (A) polysiloxane constituting the fiber treatment agent to be deposited on the conjugate fiber of the present invention must account for 75 to 97 wt % of the active components of the fiber treatment agent. In this case, the term active components refers to components remaining when water is removed from the fiber treatment agent as a whole. By having the composition ratio of Component (A) polysiloxane in the fiber treatment agent lie in the range of 75 to 95 wt %, it is possible to provide sufficient water repellency to the conjugate fiber, and concurrently the effect of another component such as an antistatic agent, etc., can be exhibited well. Processing becomes easier thereby because the occurrence of static electricity can be minimized during the step of fabricating the fiber into a nonwoven fabric.

The alkyl group in Component (B) alkane sulfonate metal salt constituting the fabric treatment agent to be deposited on the conjugate fiber of the present invention can be saturated or unsaturated, branched or linear chain, and preferably has 10 to 20 carbon atoms. One containing a C13-17 linear chain alkyl group is especially preferred. The sulfonate group in Component (B) alkane sulfonate metal salt can be present at any desired site on the carbon chain.

Component (B) alkane sulfonate metal salt constituting the fiber treatment agent used in the present invention can be one type of alkane sulfonate metal salt alone, or it can be a mixture of two or more types wherein the numbers of carbon atoms differ and the positions of the sulfonate groups differ.

The alkali metals such as sodium and potassium are preferred as the cation in Component (B) alkane sulfonate metal salt, and sodium is especially preferred for its excellent solubility in water. A commercially available product can be used as Component (B) alkane sulfonate metal salt, and examples thereof include HOSTAPUR SAS available from Clariant (Japan) K.K., EMULGATOR E30 available from LEUNA-TENSIDE GmbH, and MARLON PS available from Sasol Japan K.K.

Component (B) alkane sulfonate metal salt constituting the fiber treatment agent used in the present invention must account for 25 to 3 wt % of the active components of the fiber treatment agent. By having the composition ratio of Component (B) alkane sulfonate metal salt in the fiber treatment agent lie within a range of 25 to 3 wt %, a sufficient antistatic effect can be exhibited and also a sufficient water repellent effect by Component (A) polysiloxane can be shown with a suitable deposition of the fiber treatment agent, i.e., a deposition of 0.1 to 1.0 wt % in relation to the weight of the fiber.

However, excessive deposition of the fiber treatment agent has an adverse effect on the surface properties of the fiber and can cause fouling of the equipment because the fiber treatment agent comes off, etc., during the process of fabricating the fiber into nonwoven fabric.

Various additives can be mixed into the fiber treatment agent to be deposited on the conjugate fiber of the present invention in a range such that the object of the present invention is not lost. Examples of such additives include emulsifiers, preservatives, corrosion inhibitors, pH adjusters, antifoaming agents, etc.

The conjugate fiber of the present invention is one wherein the above fiber treatment agent is deposited at 0.1 to 1.0 wt %, and preferably 0.2 to 0.8 wt % as an active component in relation to the weight of the fiber. By having the deposition lie within the range of 0.1 to 1.0 wt %, the antistatic properties are sufficient, the occurrence of static electricity can be minimized in the step of fabricating the conjugate fiber into a nonwoven fabric, and processing becomes easier thereby. In addition, with this range of deposition the amount of treatment agent coming off the fabric is extremely small, and as a result the problems of and accumulation of the treatment agent on the equipment and the resulting decrease in process capability can be avoided.

The method for depositing the above fiber treatment agent on the conjugate fiber in the present invention is not limited to a particular method, and conventional, publicly known methods can be used therefor. As the specific method for depositing the above fiber treatment agent on the conjugate fiber, a publicly known method such as the oiling roll method, immersion method, spraying method, etc., can be used in process steps in the production of fiber such as in the so-called spinning process, in the drawing process, or in both.

The present invention has great industrial significance because the desired sufficient effect can be provided by a simple operation wherein the above Component (A) and Component (B) are deposited as a batch when the above fiber treatment agent is deposited onto the conjugate fiber. For example, a fiber treatment agent wherein the above Component (A) and Component (B) are mixed with desired additives is prepared, and the fiber treatment agent is deposited on the conjugate fiber by a suitable method during a fiber production process such as ones noted above. Alternatively, the components can also be divided up and deposited separately.

The conjugate fiber of the present invention has a plurality of thermoplastic resins as the primary component thereof. Examples of thermoplastic resins that can be used in the conjugate fiber include polyolefin polymers, polyester polymers, and polyamide polymers. Among these polyolefin polymers are preferably used because they have a high level of hydrophobicity and are very effective in satisfying the water repellency requirement, which is an object of the present invention. In addition, polyester polymers are preferably used because they have high bulk and bulk recovery capability.

Examples of polyolefin polymers include polyethylene, polypropylene, ethylene-vinyl acetate copolymers, ethylene-propylene copolymers, ethylene/octene-1 copolymers, ethylene/butene-1 copolymers, ethylene/propylene/butene-1 copolymers, etc. Examples of polyester polymers include polyethylene terephthalate, polybutylene terephthalate, poly (trimethylene terephthalate), polyethylene terephthalate/isophthalate, polyester copolymers, etc.

The conjugate fiber of the present invention comprises two or more types of thermoplastic resins as the primary component thereof, and preferably at least one type of thermoplastic resin is selected from the above polyolefin polymers and polyester polymers. Moreover, the conjugate fiber of the present invention can also contain a thermoplastic resin other than a polyolefin polymer and a polyester polymer.

When expressed as a combination of two types of thermoplastic resins constituting the highly water repellent fiber of the present invention, examples thereof include the following: polyolefin polymer/polyolefin polymer, polyolefin polymer/polyester polymer, polyester polymer/polyester polymer, polyamide polymer/polyester polymer, polyolefin polymer/polyamide polymer, polyolefin polymer/styrene polymer, etc.

Various additives can be mixed into the thermoplastic resins used in the conjugate fiber of the present invention in a range such that the object of the present invention is not lost. Examples of such additives include thermostabilizers, antioxidants, weathering resistance agents, antistatic agents, coloring agents, lubricants, etc. Another thermoplastic resin, or an inorganic substance such as titanium dioxide, calcium carbonate, magnesium hydroxide, etc., can also be blended thereinto as needed.

The cross-sectional structure of the high water repellency conjugate fiber of the present invention can be a sheath-core type, side-by-side type, hollow type, splittable type, and multilobed-modified type, or it can also be a combination type such as a side-by-side hollow type, splittable hollow type, etc. Preferred fiber cross-sectional structures for obtaining a nonwoven fabric with bulk and good texture are the sheath-core type, side-by-side type, eccentric sheath-core type, and hollow type.

To exhibit heat bonding capability in the highly water repellent conjugate fiber of the present invention, if the conjugate fiber comprises a core component and a sheath component, for example, the thermoplastic resin of the sheath component must have a lower melting point than the thermoplastic resin of the core component, and the sheath component must be exposed on the surface of the fiber.

When the highly water repellent fiber of the present invention is a sheath-core type of conjugate fiber comprising a core component and a sheath component, for example, the conjugate rate of the sheath component to the core component preferably lies within the range of 20/80 wt % to 80/20 wt %, and more preferably 40/60 wt % to 60/40 wt %.

The conjugate fiber of the present invention can be obtained by the melt spinning method. In the melt spinning method for obtaining the conjugate fiber, spinning is carried out by using a plurality of thermoplastic resins with different melting points, placing each into an extruder heated to the melting point or higher and melting the same, extruding from a conjugate spinneret such as a sheath-core type, etc., and pulling up the extruded molten resin at a constant rate while cooling. After spinning, the fiber is drawn to a specified ratio using a hot roll, etc., mechanically crimped, dried, and cut.

The fiber treatment agent disclosed above can be deposited on a conjugate fiber obtained in this manner or on a conjugate fiber within the manufacturing process to produce the highly water repellent fiber of the present invention.

The degree of fineness of the highly water repellent conjugate fiber of the present invention can be arbitrarily selected from a range of 0.5 to 30 dtex. In consideration of softness and good touch, a fineness of 1.0 to 6 dtex is preferred for processing the conjugate fiber into nonwoven fabric to be used as a material that prevents getting wet in disposable diapers and sanitary napkins.

When fabricating a nonwoven fabric using the highly water repellent conjugate fiber of the present invention, if a carding step is employed it is necessary to cut the fiber to a desired length for passage through the carding machine. In consideration of the degree of fineness and the carding machine pass-through capability, the length to which the fiber is cut, i.e., the cut length, can be selected from a range of 15 to 125 mm, and preferably will be 30 to 75 mm.

For fabricating the highly water repellent conjugate fiber of the present invention into a nonwoven fabric, after the fiber web is formed it is preferable to use a method wherein a heat treatment is performed to bring about thermal bonding of the intertwining points of the fibers constituting the fiber web to make a nonwoven fabric.

The carding method, wherein fibers cut to the kind of desired length disclosed above are passed through a carding machine, can be used as a method for forming the fiber web, and carding is the most suitable method for forming a high bulk fiber web.

Hot air bonding, hot roll bonding, etc., can be listed as publicly known methods for heat treating a fiber web formed by carding, and hot air bonding is preferred as the heat treatment method after forming the conjugate fiber of the present invention into a fiber web.

This hot air bonding method is one in which the low melting point component of the conjugate fibers constituting the fiber web is softened and melted by passing heated air and steam over the entire fiber web or a part thereof, and the intertwining parts of the fibers are bonded together thereby. This a suitable heat treatment method for providing a high bulk nonwoven fabric having favorable soft touch, which is an object of the present invention, since this method does not impair the bulkiness by pressing a certain area, unlike a hot-roll bonding method.

The high level of water repellency exhibited by the highly water repellent conjugate fiber of the present invention can be checked by using the water resistance of a nonwoven fabric manufactured using the conjugate fiber as an indicator. For example, the water resistance of the nonwoven fiber can be measured using the method of JIS L1092-A (low water pressure method), and the high level of water repellency of the fiber can be verified using a predetermined water resistance value as a standard of water repellency.

The mass per unit area (weight per unit area) of the nonwoven fabric when the highly water repellent conjugate fiber of the present invention is processed into a high bulk nonwoven fabric can be selected from a range 5 to 100 g/m$^2$. A mass per unit area of 20 to 50 g/m$^2$ is preferred as one suited for use in the material that prevents getting wet of disposable diapers and sanitary napkins based on a balance of the desired sufficient effect and cost.

The bulk of the nonwoven fabric when the conjugate fiber of the present invention is processed into a nonwoven fabric can be calculated from the specific volume (volume per unit weight) and the porosity (ratio occupied by voids per unit volume). When the nonwoven fabric becomes a high bulk fabric it is difficult to maintain water repellency because the average distance between the constituent fibers tends to increase and the number of fibers per unit volume tends to decrease. However, in the case of the nonwoven fabric of the present invention, because the fabric treatment agent deposited on the fibers is highly water repellent, the outstanding effect can be maintained even if the nonwoven fabric becomes bulkier.

When calculated by specific volume, a preferred bulk is 15 to 150 $cm^3/g$ and a more preferred bulk is 20 to 100 $cm^3/g$. In this range the outstanding effect of the present invention can best be exhibited. This range is preferred with such a high level of bulk because when the value is 15 $cm^3/g$ or more the level of the bulk will be sufficiently high, and when the value is 150 $cm^3/g$ or less, the strength of the nonwoven fabric itself is sufficiently retained.

The porosity is preferably 90 to 99%, and more preferably 95 to 99%. In this range the outstanding effect of the present invention can best be exhibited.

EXAMPLES

Next the present invention will be explained in detail using examples and comparative examples, but the present invention is not limited the examples described below. The definitions of terms and the measurement methods used in the present description, and particularly in the examples and comparative examples, are as follows.

(1) Deposited Amount of Treatment Agent

This value shows the ratio of treatment agent deposited on the fibers in relation to the weight of the fibers, and is calculated by the extraction method. (Units: wt %).

A fiber web was fabricated by passing 50 g of sample short fibers through a miniature roller carding machine, 2 g were removed from the fiber web, and the measurement was performed using a high speed resin residue extractor. For the extraction medium, 25 mL of 2-propanol was used. The amount of deposition was calculated using the following formula.

$$\text{Amount of deposition (wt \%)}=(\text{extracted amount (g)}/2)\times 100$$

(2) Antistatic Properties

This shows the voltage value of static electricity produced in the carding process. (Units: V (volts))

At 20° C. in an atmosphere with 45% RH, a fiber web was fabricated by passing 50 g of sample short fibers through a 500 mm wide miniature roller carding machine at an exit roller speed of 7 m/min, and the voltage of static electricity generated by the fiber web during passage between the carding machine exit and the collection drum was measured. It was concluded that if the voltage is less than 100 V, the static electricity could be sufficiently controlled when the fiber is processed, and the processing could be carried out smoothly.

(3) Mass Per Unit Area

This shows the weight per unit area in a nonwoven fabric and fiber web, and it is calculated from the weight of a nonwoven fabric or fiber web cut to a specified area. (Units: $g/m^2$)

A sample of nonwoven fabric cut to 250 mm×250 mm was weighed on an electronic pan balance, and the numerical value was multiplied 16 times to arrive at the mass per unit area.

(4) Bulk (Specific Volume and Porosity)

(i) Specific volume shows the weight per unit volume of a nonwoven fabric, and it is calculated from the measured mass per unit area and measured thickness. (Units: $cm^3/g$)

The thickness of the nonwoven fabric was measured using a thickness measurement device under conditions of a load of 3.5 $g/cm^2$ and a rate of 2 mm/sec, and the specific volume was calculated using the numerical value for thickness (mm) and mass per unit area ($g/m^2$) according to the following formula.

$$\text{Specific volume}=t/w\times 1000$$

t: thickness of the sample of nonwoven fabric (mm)

w: mass per unit area ($g/m^2$)

(ii) Porosity: This measures the ratio occupied by voids per unit volume of nonwoven fabric, and it is calculated from the mass per unit area and thickness of the nonwoven fabric, and the specific gravity of the constituent fibers. (Units: %)

The thickness of the nonwoven fabric was measured using a thickness measurement device under conditions of a load of 3.5 $g/cm^2$ and a rate of 2 mm/sec, and the porosity was calculated using the numerical value for thickness (μm), mass per unit area ($g/m^2$) and the specific gravity of the constituent fibers ($g/cm^3$) according to the following formula.

$$\text{Porosity}=\{(t-w/\rho)/t\}\times 100$$

t: thickness of the sample of nonwoven fabric (μm)

w: mass per unit area of the sample of nonwoven fabric ($g/m^2$)

ρ: specific gravity of constituent fibers ($g/cm^3$)

(5) Water Repellency

This shows the water resistance of the nonwoven fabric. (Units: mm)

A 150 mm×150 mm sample of nonwoven fabric was cut out and measured at rate of increase of 10 cm/min in accordance with JIS L1092-A (low water pressure method). The higher the water resistance value is, the better the water repellency. It was concluded that if the water resistance value is 40 mm or more, the water repellency of the conjugate fiber serving as the material is sufficient, and a highly water repellent nonwoven fabric that is satisfactory as a commercial product has been provided.

(6) Softness

The visual uniformity, softness to the touch, stiffness, puffiness, etc., of the nonwoven fabric were evaluated. A 150 mm×150 mm sample of nonwoven fabric was cut out, and evaluated in an organoleptic test by a five-member panel.

The test was scored on a three-step scale:

○: Judged "good" by all five members

Δ: Judged "poor" by 1 to 2 members x: Judged "poor" by four or more members

Example 1

A 50%/50% by weight sheath-core conjugate fiber was spun using a 350-nozzle sheath-core conjugate spinneret at a temperature of 220 to 280° C. with a pull-up rate of 800 m/min by using crystalline polypropylene with a melt mass flow rate (conditions: 230° C., load of 21.18 N) of 15 g/10 min, and a melting point of 162° C. as the core component, and a high density polyethylene with a density of 0.96 $g/cm^3$, melt index (conditions: 190° C., load of 21.18 N) of 16 g/10 min, and a melting point of 131° C. as the sheath component. After spinning, the fibers were drawn to 4 times in a drawing ratio using a hot roll at 90° C., and fiber treatment agent 1 shown in Table 1 was deposited during the drawing process in the form of an aqueous emulsion containing 10 wt % active components using an oiling roll. The fiber whereon the fiber treatment agent had been deposited was mechanically crimped, and after drying and cutting, sample short fibers 51 mm long with a fineness of 2.2 dtex were obtained.

The amount of deposition and antistatic properties of the resulting sample short fibers were measured using measurement methods (1) and (2) above. The results are shown in Table 2.

Additionally, 50 g of the resulting sample short fibers were made into fiber webs by carding using a miniature roller carding machine. The fiber webs were passed through a hot air circulation heat treatment processing machine under conditions of a setting temperature of 130° C., an average hot air flow rate of 0.8 m/sec and a processing time of 12 sec to make a sample nonwoven fabric by the hot-air bonding method.

Example 2

Sample short fibers were obtained in the same manner as in Example 1 except that fiber treatment agent 2 shown in Table 1 was used in the drawing step. The amount of deposition and antistatic properties of the resulting sample short fibers were measured using measurement methods (1) and (2) above. The results are shown in Table 2.

A sample nonwoven fabric was also obtained in the same manner as in Example 1.

Example 3

Sample short fibers were obtained in the same manner as in Example 1 except that fiber treatment agent 3 shown in Table 1 was used in the drawing step. The amount of deposition and antistatic properties of the resulting sample short fibers were measured using measurement methods (1) and (2) above. The results are shown in Table 2.

A sample nonwoven fabric was also obtained in the same manner as in Example 1.

Comparative Example 1

Sample short fibers were obtained in the same manner as in Example 1 except that fiber treatment agent 4 shown in Table 1 was used in the drawing step. The amount of deposition and antistatic properties of the resulting sample short fibers were measured using measurement methods (1) and (2) above. The results are shown in Table 2.

A sample nonwoven fabric was also obtained in the same manner as in Example 1.

Comparative Example 2

Crystalline polypropylene with a melt mass flow rate of 15 g/10 min (conditions: 230° C., load of 21.18 N), and a melting point of 162° C. was spun using a 350-nozzle spinneret at a temperature of 260 to 280° C. with a pull-up rate of 800 m/min. In the spinning process, treatment agent 5 shown in Table 1 was deposited at a target amount of deposition of 0.6 wt % in the form of an aqueous emulsion containing 5 wt % active components using an oiling roll. After spinning, the fibers were drawn to 4 times in a drawing ratio using a hot roll at 90° C., and fiber treatment agent 6 shown in Table 1 was additionally deposited during the drawing process at a target amount of deposition of 0.1 wt % in the form of an aqueous emulsion containing 10 wt % active components using an oiling roll. The fiber whereon the fiber treatment agent had been deposited was mechanically crimped, and after drying and cutting, sample short fibers 51 mm long with a fineness of 2.2 dtex were obtained.

The amount of deposition and antistatic properties of the resulting sample short fibers were measured using measurement methods (1) and (2) above. The results are shown in Table 2.

Additionally, 50 g of the resulting sample short fibers were made into fiber webs by carding using a miniature roller carding machine. The fiber webs were passed between two heated rolls, one roll having a convex member engraved thereon, and partial thermo-compression bonding was performed thereby to obtain sample nonwoven fabric. The conditions in this hot roll bonding method were a surface temperature of 154° C., rotation rate of 0.6 m/min, linear load of 196 N/cm, and compression bonding area ratio of 25%.

Comparative Example 3

Sample short fibers were obtained in the same manner as in Example 1 except that fiber treatment agent 7 shown in Table 1 was used in the drawing step.

Comparative Example 4

A nonwoven fabric with a compression bonding area ratio of 14% and a filament fineness of 2.3 dtex that was obtained by the spunbond method from crystalline polypropylene having a melting point of 160° C. was used as the sample nonwoven fabric.

Using methods (3) to (6) above, the mass per unit area, bulk, water repellency, and softness were evaluated in each of the sample nonwoven fabrics obtained as described above. The results are shown in Table 2.

TABLE 1

(Units: wt % in active component)

| | Treatment agent No. | | | | | | |
|---|---|---|---|---|---|---|---|
| Treatment agent component | 1 | 2 | 3 | 4 | 5 | 6 | 7 |
| Polydimethylsiloxane*[1] | 75 | 90 | 97 | 65 | — | 95 | 35 |
| Sodium alkane sulfonate*[2] | 25 | 10 | 3 | 35 | — | — | — |
| Phosphate alcohol ester | — | — | — | — | 100 | 5 | — |
| Ethylene oxide-added (20) stearyl amine | — | — | — | — | — | — | 35 |
| Cetyl phosphate ester K salt | — | — | — | — | — | — | 30 |

*[1]DOW CORNING TORAY SH 200 C FLUID from Dow Corning Toray Silicone Co., Ltd.
*[2]HOSTAPUR SAS from Clariant (Japan) K.K.

TABLE 2

| | | Example | | | Comparative Example | | | |
|---|---|---|---|---|---|---|---|---|
| | | 1 | 2 | 3 | 1 | 2 | 3 | 4 |
| Treatment agent No. | | 1 | 2 | 3 | 4 | 5, 6 | 7 | — |
| Amount of deposition (%) | | 0.15 | 0.35 | 1.0 | 0.35 | 0.7 | 0.4 | 0 |
| Antistatic properties (V) | | 30 | 30 | 80 | 30 | 800 | 50 | — |
| Mass per unit area of nonwoven fabric ($g/m^2$) | | 25 | 25 | 25 | 25 | 25 | 25 | 25 |
| Bulk | Specific volume ($cm^3/g$) | 50 | 50 | 50 | 50 | 10 | 50 | 10 |
| | Porosity (%) | 98 | 98 | 98 | 98 | 89 | 98 | 89 |
| Water repellency (mm) | | 60 | 70 | 80 | 15 | 70 | 25 | 80 |
| Softness | | ○ | ○ | ○ | ○ | x | ○ | x |

INDUSTRIAL APPLICABILITY

The highly water repellent fiber of the present invention has excellent antistatic properties, so no trouble caused by static electricity occurs in the step of processing the same into a nonwoven fabric. A nonwoven fabric fabricated using the highly water repellent fiber of the present invention has high bulk and excellent water repellency. Therefore, the nonwoven fabric can be most suitably used for a material that prevents getting wet or water impermeable sheets in disposable diapers, sanitary napkins, absorbent pads, etc.

The invention claimed is:

1. A highly water repellent and highly antistatic fiber that is a treated conjugate fiber comprising:

a conjugate fiber having a plurality of thermoplastic resins as the primary component thereof; and a fiber treatment agent that is provided on an external surface of the conjugate fiber, the fiber treatment agent comprising at least Component (A) and Component (B) below and is present in an amount of 0.1 to 1.0 wt % in relation to the weight of the conjugate fiber, with Component (A) accounting for 75 wt % and Component (B) accounting for 25 wt % of the components of the fiber treatment agent remaining when water is removed from the fiber treatment as a whole:

Component (A): polydimethylsiloxane

Component (B): alkane sulfonate metal salt, wherein the treated conjugate fiber is obtained by depositing the fiber treatment agent on the external surface of the conjugate fiber, and wherein the treated conjugated fiber has a voltage value of static electricity that is less than 100V when measured after being subjected to carding at 20° C. and 45% relative humidity.

2. The highly water repellent and highly antistatic fiber according to claim 1, wherein at least one of said plurality of thermoplastic resins is a polyolefin polymer or polyester polymer.

3. A high bulk nonwoven fabric fabricated by a process including a carding step using the highly water repellent and highly antistatic fiber according to claim 1.

* * * * *